US007909556B2

(12) United States Patent
Thillen et al.

(10) Patent No.: US 7,909,556 B2
(45) Date of Patent: Mar. 22, 2011

(54) CHARGING DEVICE AND DISTRIBUTION CHUTE FOR A SHAFT FURNACE

(75) Inventors: Guy Thillen, Diekirch (LU); Jeannot Loutsch, Mondercange (LU)

(73) Assignee: Paul Wurth S.A., Luxembourg (LU)

( * ) Notice: Subject to any disclaimer, the term of this patent is extended or adjusted under 35 U.S.C. 154(b) by 203 days.

(21) Appl. No.: 11/917,892

(22) PCT Filed: Jun. 16, 2006

(86) PCT No.: PCT/EP2006/063280
§ 371 (c)(1),
(2), (4) Date: Dec. 17, 2007

(87) PCT Pub. No.: WO2006/134165
PCT Pub. Date: Dec. 21, 2006

(65) Prior Publication Data

US 2009/0129896 A1 May 21, 2009

(30) Foreign Application Priority Data

Jun. 15, 2005 (LU) ..... 91176

(51) Int. Cl.
*F23K 3/16* (2006.01)

(52) U.S. Cl. ..... 414/153; 414/203; 414/206; 110/116; 266/199

(58) Field of Classification Search ..... 414/152, 414/153, 203, 206, 293; 110/116; 266/199
See application file for complete search history.

(56) References Cited

U.S. PATENT DOCUMENTS 4,032,024 A * 6/1977 Genge et al. ..... 414/199

FOREIGN PATENT DOCUMENTS

| | | |
|---|---|---|
| EP | 0 062 769 | 10/1982 |
| EP | 0 863 215 | 9/1998 |
| JP | 11 001709 | 1/1999 |

(Continued)

OTHER PUBLICATIONS

JP 11 001709 A (Nouchi et al.) Jan. 1, 2006 (English machine translation of foreign publication already of record on applicant's IDS of Dec. 17, 2007). [online] [retrieved Sep. 17, 2009]. Retrieved from: http://dossier1.ipdl.inpit.go.jp/AIPN/odse_top_dn.ipdI?N0000=7400.*

(Continued)

*Primary Examiner* — Saúl J Rodríguez
*Assistant Examiner* — Johathan D Snelting
(74) *Attorney, Agent, or Firm* — Cantor Colburn LLP

(57) ABSTRACT

A charging device for a shaft furnace comprises a distribution chute for bulk material and a drive mechanism for the distribution chute. The distribution chute has a trough-shaped main part with an open impact section and an outlet section. The main part provides a sliding channel between the impact section and the outlet section. The drive mechanism for the distribution chute is capable of rotating the distribution chute about an essentially vertical axis and pivoting the distribution chute about an essentially horizontal axis so as to allow distribution of bulk material on a charging surface of the shaft furnace. According to the present invention, the distribution chute comprises a circumferentially closed funnel portion which tapers in the direction of flow and is arranged downstream of the impact section and with its outlet at the downstream end of said trough-shaped main part.

24 Claims, 3 Drawing Sheets

FOREIGN PATENT DOCUMENTS

| | | |
|---|---|---|
| JP | 2000 119711 | 4/2000 |

OTHER PUBLICATIONS

JP 2000 119711 A (Sasaki, Takeshi) Apr. 25, 2000 (English machine translation of foreign publication already of record on applicant's IDS of Dec. 12, 2007). [online] [retrieved Sep. 17, 2009]. Retrieved from: http://dossier1.ipdl.inpit.go.jp/AIPN/odse_top_dn.ipdl?N0000=7400.*

International Search Report; PCT/EP2006/063280; Dec. 14, 2006.

* cited by examiner

CHARGING DEVICE AND DISTRIBUTION CHUTE FOR A SHAFT FURNACE

TECHNICAL FIELD OF THE INVENTION

The present invention relates to a charging device for a shaft furnace, in particular for a blast furnace. The present invention also relates to a distribution chute for use in such a charging device.

BRIEF DESCRIPTION OF RELATED ART

In blast furnaces, charging devices of the so-called "bell-less" type have found widespread use over the past decades. These charging devices are arranged at the furnace top and comprise a distribution chute and a drive mechanism to which the chute is mounted. During the charging procedure, charge material is discharged in bulk from a hopper through a central feed channel onto the distribution chute. The drive mechanism rotates the distribution chute about a first essentially vertical axis and pivots the chute about a second essentially horizontal axis. As a result, any desired charge profile, i.e. distribution of bulk material (burden) over the charging surface of the blast furnace, can be achieved.

In a particular charge profile, a vertical coke shaft or coke chimney is provided around the central axis of the blast furnace by charging coke centrally. Such a coke chimney serves to improve the operation of the blast furnace by increasing draft. Furthermore, such a coke chimney allows to feed coarse coke to the centre in order to increase permeability of the dead man. In order to create this central coke chimney within the burden, the distribution chute is pivoted into a central charging position. In this position, the chute should ideally not intercept the flow of bulk material which falls vertically from the central feed channel.

EP 0 062 769 discloses a charging device for a shaft furnace with a distribution chute that has a tapering tubular shape. Although an integrally funnel shaped type of distribution chute according to EP 0 062 769 allows accurate centre charging, it is not suitable for blast furnaces which require the chute to be pivotable to small inclination angles (close to horizontal) and/or for charging devices which require the pivoting axis of the chute to be offset from the central axis of the chute.

With many known charging devices and distribution chutes, it is however often impossible to completely avoid interception of the burden flow during central charging. For example, constructional constraints often make it impossible to pivot the distribution chute into a fully vertical position or a position sufficiently out of the way, such that its outlet portion remains partially within the charge path during central charging. The burden flow is thereby partially deflected, which of course is detrimental to central charging. There is a similar problem in case the distribution chute comprises one or more transverse bars for imparting rigidity to its trough-shaped main part. Such transverse bars typically form an obstruction which intercepts and scatters the burden flow during central charging, even if the main part of the chute itself is positioned sufficiently out of the way.

JP 11 001709 discloses a distribution chute with an auxiliary shoot fixed to the downstream end of the trough-shaped main part. The auxiliary shoot comprises tapering side plates for limiting the spread of the burden flow in lateral direction and a reflecting plate for redirecting the burden flow that exits the main part towards the centre of the furnace when the chute is in central charging position.

JP 07 179916 discloses a distribution chute comprising a trough-shaped main part and an additional straightening chute that is pivotably supported at the tip end of the main part for redirecting the burden flow vertically. This distribution chute comprises a link rod coupled to the straightening chute and to the support structure of the main part, so as to form a parallelogram linkage mechanism that maintains the straightening chute in vertical orientation. Besides improving burden distribution in radial direction, the distribution chute according to JP 07 179916 may also improve central charging if the straightening chute is funnel shaped.

BRIEF SUMMARY OF THE INVENTION

The invention provides a charging device for a shaft furnace with a distribution chute of simple construction that improves central charging of bulk material.

The invention further provides a charging device for a shaft furnace which comprises a distribution chute for bulk material and a drive mechanism for the distribution chute. The distribution chute has a trough-shaped main part with an open impact section and an outlet section. The main part provides a sliding channel between the impact section and the outlet section. The drive mechanism for the distribution chute is capable of rotating the distribution chute about an essentially vertical axis and pivoting the distribution chute about an essentially horizontal axis so as to allow distribution of bulk material on a charging surface of the shaft furnace. According to the invention, the distribution chute comprises a circumferentially closed funnel portion which tapers in the direction of flow and is arranged downstream of the impact section and with its outlet at the downstream end of the trough-shaped main part. When the distribution chute is in central charging position, this funnel portion insures that the flow of bulk material is centred and guided onto the desired target area of the charging surface, i.e. the centre of the furnace. Undesired deflection and uncontrolled distribution of charge material are thereby avoided. In addition, the funnel portion provides rigidity to the distribution chute. Arranging the outlet of the funnel portion at the downstream end of the trough-shaped main part enables centering of the burden flow at the lowermost end of the distribution chute when the latter is in central charging position. There is no need for significant deviation of the burden flow and hence the exposure of the circumferentially closed funnel portion to the considerable abrasive wear caused by the burden is minimal. Furthermore, since the circumferentially closed funnel portion imparts rigidity to the distribution chute in the outlet section, the need for additional stabilizing transverse bars can be eliminated. As will be appreciated, use of this charging device is beneficial to any kind of charging procedures which involve central charging in general and formation of so-called "coke chimneys" in particular.

As opposed to JP 07 179916, with the distribution chute according to the invention, there is no need for associating an additional mechanism that would be exposed to the severe inner atmosphere of the furnace with the distribution chute. In contrast to JP 11 001709, the inside surfaces of the funnel portion are arranged so as to be subject to a minimum of wear caused by the burden during central charging, because the deviation angle of the centred burden flow is relatively small. Furthermore, and also in contrast to JP 11 001709 and JP 07 179916, the total length of the distribution chute is not increased by the funnel portion since its outlet is arranged at the downstream end of the trough-shaped main part.

According to a preferred embodiment, the funnel portion has an apex half angle greater than or equal to the angle enclosed between the longitudinal axis of the trough-shaped main part and the vertical when the distribution chute is in central charging position. The apex half angle is to be understood as half of the apex angle of a cone whose surface generates the shape of the funnel portion. It may be noted that this cone may have a general, i.e. not necessarily circular, base and need not be a right cone.

In case the charging device comprises a central feed channel arranged above the distribution chute for feeding bulk material onto the distribution chute, it is preferable that the outlet cross section of the funnel portion approximately equals the outlet cross section of this central feed channel.

In another preferred embodiment, the funnel portion is limited to 10-50% of the length of the distribution chute starting from the downstream end of the main part. The funnel portion covers the outlet section and/or the sliding channel, but it does not, at least not entirely, cover the impact section. In fact, the latter needs to be accessible for receiving bulk material during the usual (non-central) charging procedure. To this effect, the open impact section advantageously extends over at least 40% of the length of the trough-shaped main part starting from the upstream end of the main part such that bulk material can be fed to the distribution chute over a wide range of inclination angles.

From a structural point of view, the funnel portion can be divided into a chute portion of the trough-shaped main part and a cover portion covering the chute portion. In this case, the cover portion may comprise a cover having a shape which is generated by a frustum of a cone. Again, this cone need not be a right circular cone but may have any suitable, generally conical configuration. In another variant, the cover portion comprises an inclined cover plate arranged at an angle with respect to the main part and lateral linking plates for fixing the inclined cover plate to the main part. In yet another variant, the cover portion comprises a first upstream inclined cover plate, a second downstream inclined cover plate, the first and second inclined cover plates being arranged at an angle with respect to the main part, and lateral linking plates for fixing the first and second inclined cover plates to the main part. In both of the latter cases, the angle by which the inclined plate(s) is (are) mounted, is chosen analogous to the aforementioned apex half angle.

As will be appreciated, the funnel portion is preferably arranged so as to guide and centre a flow of bulk material on the central axis of the shaft furnace when the distribution chute is in central charging position.

Preferably, the distribution chute comprises mounting flanges for mounting the distribution chute to the drive mechanism, the flanges being configured such that the longitudinal central axis of the main part is offset from the essentially horizontal pivoting axis.

The invention also proposes a distribution chute for a charging device as described above. According to the invention, the distribution chute comprises a circumferentially closed funnel portion which tapers in the direction of flow and is arranged downstream of the impact section and with its outlet at the downstream end of said trough-shaped main part.

As will be appreciated, the distribution chute and the charging device according to the present invention are particularly suitable for use in a metallurgical blast furnace.

BRIEF DESCRIPTION OF THE FIGURES

The present invention will be more apparent from the following description of not limiting preferred embodiments with reference to the attached drawings. In the drawings, in which identical or similar parts are identified by identical reference numerals throughout.

DETAILED DESCRIPTION OF THE INVENTION

Figure 1:
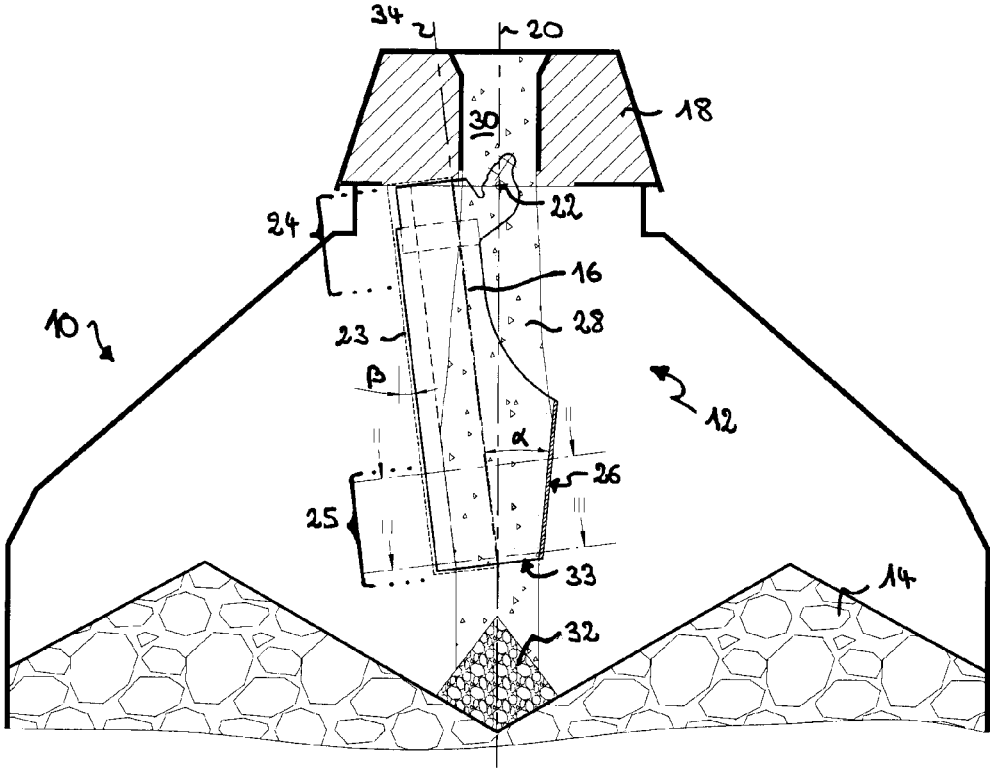
FIG. 1: is a vertical cross-sectional view of a first embodiment of a charging device with a distribution chute according to the invention.

FIG. 1 shows a furnace throat of a blast furnace generally identified by reference numeral 10. The top closing on the throat of blast furnace 10 comprises a charging device 12 for charging a burden 14 of bulk material such as ore and coke into the blast furnace 10. The charging device 12 comprises a distribution chute 16 and a drive mechanism 18 to which the distribution chute 16 is mounted.

In a manner known per se, the drive mechanism 18 is configured for rotating and pivoting the distribution chute 16. During the charging procedure, it rotates the distribution chute 16 about the vertical central axis 20 of the blast furnace 10 and pivots the distribution chute 16 about an essentially horizontal axis 22, i.e. about mounting shafts by which the drive mechanism 18 holds the distribution chute 16. A detailed description of such a drive mechanism 18 is given e.g. in U.S. Pat. No. 3,880,302 and therefore omitted here.

In FIG. 1, the distribution chute 16 is shown in central charging position i.e. pivoted down into an almost vertical position. The distribution chute 16 comprises a trough-shaped main part 23. In this embodiment the main part 23 has the shape of a longitudinal half of a tube, i.e. a semi-cylindrical hollow body, other configurations, e.g. distribution chutes having (semi-)rectangular cross-sections, are however not excluded. In a manner known per se, the main part 23 has an open impact section 24, which means that the impact section 24 is not circumferentially closed, for receiving bulk material and an outlet section 25 for delivering bulk material onto a given point of the charging surface of the blast furnace 10. When the distribution chute 16 is less inclined than shown in FIG. 1, the main part 23 provides a trough-shaped sliding channel between the open impact section 24 and the outlet section 25.

As will be appreciated, the distribution chute 16 further comprises a circumferentially closed funnel portion 26 which tapers in the direction of flow i.e. from the impact section 24 towards the outlet section 25. In fact, during central charging as shown in FIG. 1, a free falling flow 28 of bulk material is fed vertically via a central feed channel 30 into the central region of the blast furnace 10. This allows for example to form a central coke chimney within the burden 14 as schematically indicated at 32. As will be appreciated, the impact section 24 is open on the side opposite to the bottom of the main part 23 i.e. open towards the central feed channel 30 over a substantial portion, preferably at least 40%, of the length of the main part 23 so as to allow receiving bulk material from the central feed channel 30 in any position, i.e. from small inclination (nearly horizontal) angles to high inclination angles (nearly vertical), of the distribution chute 16. When the distribution chute 16 is in central charging position as shown in FIG. 1, the funnel portion 26 insures centring and guiding of the flow 28 of bulk material onto the central axis 20 of the blast furnace 10. It may be noted that the distribution chute 16 is normally rotated about the central axis 20 during central charging, with the funnel portion 26 this rotation is however not mandatory. As shown in FIG. 1, the outlet 33 is arranged at the downstream end of the main part 23, i.e. the outlet 33 of the funnel portion 26 per se coincides with the outlet of the distribution chute 16. The funnel portion 26 covers the outlet section 25 and part of the sliding channel in between the open i.e. uncovered impact section 24 and the outlet section 25. In the embodiment of FIG. 1, the funnel portion 26 extends over approximately 42% of the total length of the distribution chute 16 (values from 10%-50% being preferred). As seen in FIG. 1, the funnel portion 26 is arranged downstream of the impact section 24. In other words, funnel portion 26 does not cover the open impact section 24 onto which bulk material is fed during radial and circumferential charging, i.e. when the distribution chute 16 is not in central charging position.

As further seen in FIG. 1, the funnel shaped portion 26 is designed such that its summit line is at an angle $\alpha$ with the longitudinal central axis 34 of the main part 23. The angle $\alpha$ corresponds to half of the apex angle of an imaginary cone matching the funnel shaped portion. The angle $\alpha$ is preferably chosen greater than, or at least equal to an angle $\beta$, defined by the trough line of the main part 23 and the vertical central axis 20, when the distribution chute 16 is in central charging position. In fact, the angle $\beta$ depends on constructional constraints and is generally greater than zero. By choosing the angle $\alpha$ and the minimum clearance between the summit line and the trough line accordingly, it is insured that the flow 28 is entirely collected and centred.

Figure 2:
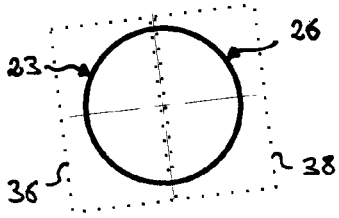
FIG. 2: is a cross-sectional view along plane II-II of the distribution chute according to FIG. 1.
Figure 3:
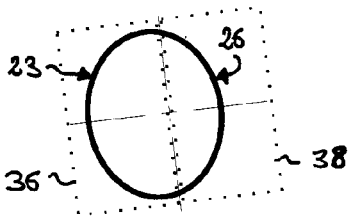
FIG. 3: is a cross-sectional view along plane III-III of the distribution chute according to FIG. 1.

As best seen in FIGS. 2 and 3, the free passage cross-sectional area of the funnel portion 26 decreases in the direction of flow. At the outlet 33, the cross-sectional area of the funnel portion 26 shown in FIG. 3 is chosen so as to be essentially equal to the free passage cross-sectional area at the outlet of the central feed channel 30. Furthermore, the surface defined by the outlet 33 is approximately perpendicular to the longitudinal central axis 34 of the main part 23. This insures optimum concentration and centring of the flow 28 while avoiding detrimental congestion of bulk material in the funnel portion 26. Depending on the type of charge material and on the vertical distance between the outlet of the central feed channel 30 and the outlet 33 during central charging, the cross-sectional area of the outlet 33 may also be configured smaller than cross-sectional area of the outlet of the central feed channel 30. As a matter of fact, the flow 28 may taper in downward direction due to gravitational acceleration such that a smaller cross-section of the outlet 33 may improve centering without causing congestion.

As further seen in FIGS. 1 to 3, the slanting funnel portion 26 according to the first embodiment comprises an essentially semi-cylindrical chute portion 36 of the main part 23 and a cover portion 38 connected to the main part 23. As seen in FIG. 1, the cover portion 38 comprises a cover member having the shape of a lateral surface portion of a frustum of a cone. To provide this arrangement, the essentially semi-cylindrical portion 36 and the frusto-conical cover portion 38 can be integrally formed out of a suitably shaped single steel plate which is bent and welded into shape. A similar distribution chute 16 can be obtained by machining an entirely cone-shaped pre-form funnel or alternatively, by fixing together two separate parts having the shape of the portions 36, 38. It may be noted that the latter procedure allows to retrofit existing chutes with a funnel shaped portion 26 and that the former procedure provides a main part which is conical rather than semi-cylindrical.

Figure 4:
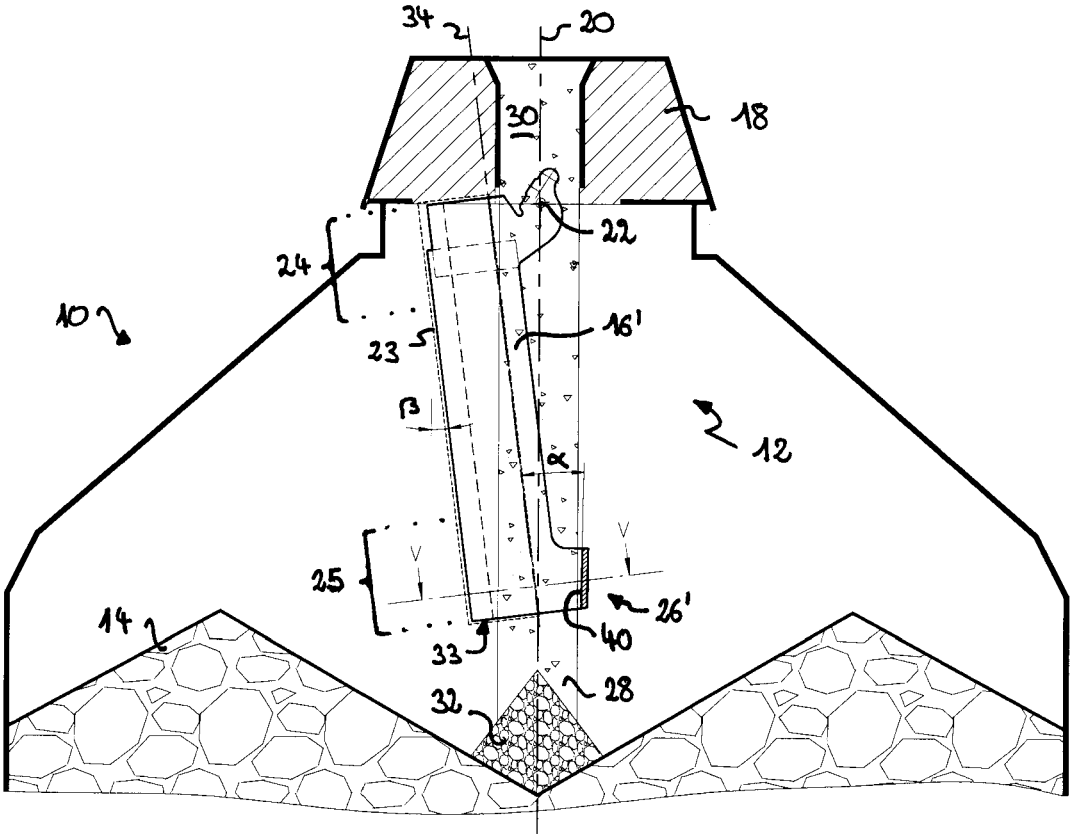
FIG. 4: is a vertical cross-sectional view of a second embodiment of a charging device with a distribution chute according to the invention.
Figure 5:
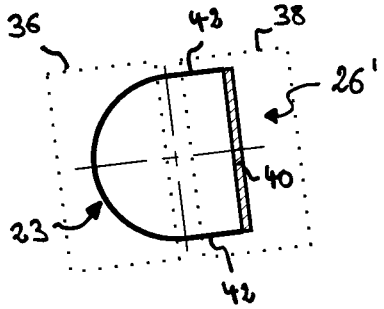
FIG. 5: is a cross-sectional view along plane V-V of the distribution chute according to FIG. 4.

FIGS. 4 and 5 show a second embodiment of the charging device 12 according to the invention. For the sake of conciseness, only those aspects in which the second embodiment differs from the first embodiment are detailed below.

In FIGS. 4 and 5, the distribution chute 16' comprises a circumferentially closed funnel portion 26' having a reduced length when compared to the first embodiment. The funnel shaped portion 26' of this embodiment is limited to approximately 15% of the length of the distribution chute 26. The funnel portion 26' is arranged in the outlet section 25 of the main part 23 only. While insuring similar effectiveness in the central charging position as shown, this embodiment allows reducing the total weight as well as material and manufacturing cost of the distribution chute 16'.

As seen in FIG. 5, the funnel portion 26' comprises an essentially semi-cylindrical chute portion 36 of the main part 23. It furthermore comprises a cover portion 38 having an inclined cover plate 40 arranged at an angle $\alpha$, with respect to said main part 23 and lateral linking plates 42 for fixing the inclined cover plate 40 to the main part 23. As will be appreciated, the angle $\alpha$ is chosen according to the same principle and has the same effect as mentioned above. The height of the linking plates 42 is chosen such as to warrant that the free passage cross-sectional area at the outlet of the funnel portion 26 is essentially equal to the free passage cross-sectional area at the outlet of the central feed channel 30. As mentioned above, it is not excluded to design the distribution chute 16, 16' such that the free passage cross-sectional area at the outlet 33 of the funnel portion 26 is smaller than the free passage cross-sectional area at the outlet of the central feed channel 30.

Figure 6:
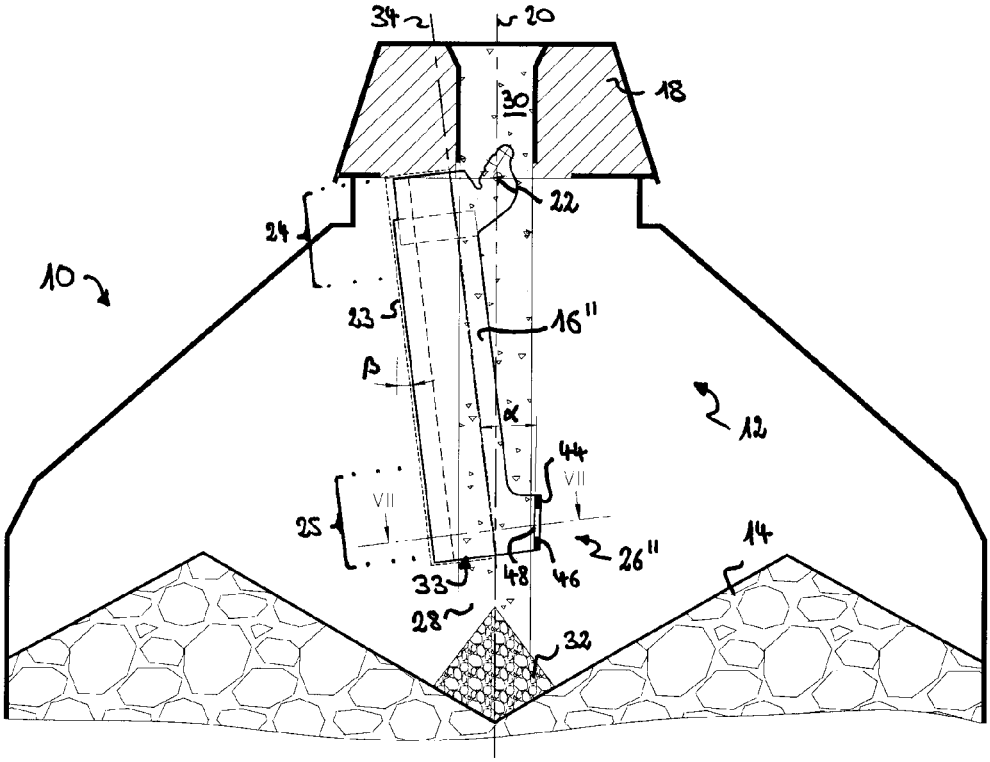
FIG. 6: is a vertical cross-sectional view of a third embodiment of a charging device with a distribution chute according to the invention.
Figure 7:
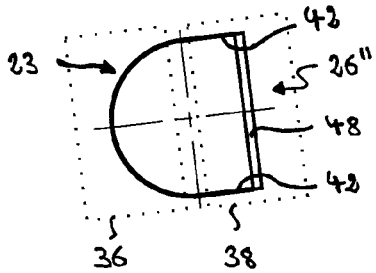
FIG. 7: is a cross-sectional view along plane VII-VII of the distribution chute according to FIG. 6.

FIGS. 6 and 7 show a third embodiment of the charging device 12 according to the invention. For the sake of conciseness, only those aspects in which the second embodiment differs from the previously described embodiments are detailed below.

The distribution chute 16" shown in FIG. 6 has an overall configuration similar to that of the distribution chute 16' shown in FIG. 4. The essential difference resides in the fact that the inclined cover plate 40 of the distribution chute 16' has been replaced by a first upstream inclined cover plate 44 and a second downstream inclined cover plate 46. The inclined cover plates 44, 46 are arranged with an intermediate gap 48 on the linking plates 42 as seen in FIG. 7. Surprisingly, it has been found that, provided the cover plates 44, 46 have sufficient effective dimension in the flow direction, the presence of the gap 48 has little adverse effect if any on concentration, centering and guiding of the flow 28. Thus the configuration of the funnel portion 26" shown in FIGS. 6 and 7 allows further savings in total weight and material cost.

It will be appreciated that the funnel shaped portions 26, 26', 26" as previously described allow to impart rigidity to the main part 23 and, in particular, to insure that the outlet section 25 is not deformed due to thermal and/or mechanical stress. Compared to known braces or transverse links provided for the same purpose, this effect is achieved by the funnel shaped portions 26, 26', 26" without any detrimental influence on central charging.

It remains to be noted that, in any of the preceding embodiments, the main part 23 is preferably made of heat resistant steel and may comprise an inward cladding of wear resistant material (not shown) as well as so called stone boxes as described e.g. in EP 0 640 539. Advantageously, the slanting funnel portion 26, 26, 26", in particular the cover portion 38, is also provided with an inward cladding of wear resistant material in those regions which are subject to abrasive stress. In general, in the circumferentially closed funnel portion 26, 26, 26" or at least in the region near the outlet 33, the inner surface of the distribution chute 16; 16'; 16" is smooth, e.g. devoid of stone boxes and other protrusions, whereby uniform discharging of charge material is warranted. The distribution chute 16; 16'; 16" may further comprise a cooling arrangement as described in GB 2 281 610 if required. Furthermore, as seen in FIGS. 1, 4 and 6, the distribution chute 16; 16'; 16" has duckbill-shaped mounting flanges for removable mounting of the distribution chute 16; 16'; 16" to the drive mechanism 18 by means of mounting shafts defining the horizontal pivoting axis 22. By virtue of the mounting flanges, the longitudinal central axis 34 of the main part 23 is offset from the horizontal pivoting axis 22.

The invention claimed is:

1. A charging device for a shaft furnace comprising:

a distribution chute for distributing bulk material on a charging surface of said shaft furnace;

a drive mechanism capable of rotating said distribution chute about an essentially vertical axis and pivoting said distribution chute about an essentially horizontal axis so as to allow distribution of bulk material on said charging surface;

said distribution chute having a trough-shaped main part with an open impact section and an outlet section, said trough-shaped main part providing a sliding channel between said open impact section and said outlet section, wherein said distribution chute comprises a funnel portion arranged downstream of said open impact section, said funnel portion being defined by at least one circumferentially closed region of said sliding channel, wherein said circumferentially closed region of said sliding channel tapers in a direction of flow towards a downstream extent of said trough-shaped main part such that an outlet of said funnel portion is arranged substantially at said downstream extent of said trough-shaped main part.

2. The charging device according to claim 1, wherein said funnel portion has an apex half angle greater than or equal to the angle enclosed between a longitudinal axis of said trough-shaped main part and the vertical when said distribution chute is in a central charging position.

3. The charging device according to claim 1, further comprising a central feed channel arranged above said distribution chute for feeding bulk material onto said distribution chute and wherein an outlet cross section of said funnel portion approximately equals an outlet cross section of said central feed channel.

4. The charging device according to claim 1, wherein said funnel portion is limited to 10-50% of the length of said distribution chute.

5. The charging device according to claim 4, wherein said funnel portion covers said outlet section and/or said sliding channel.

6. The charging device according to claim 1, wherein said open impact section extends over at least 40% of the length of said trough-shaped main part.

7. The charging device according to claim 5, wherein said open impact section extends over at least 40% of the length of said trough-shaped main part.

8. The charging device according to claim 1, wherein said funnel portion is arranged so as to guide and centre a flow of bulk material on a central axis of said shaft furnace when said distribution chute is in central charging position.

9. The charging device according to claim 1, wherein said distribution chute comprises mounting flanges for mounting said distribution chute to said drive mechanism, said flanges being configured such that a longitudinal central axis of said main part is offset from said essentially horizontal pivoting axis.

10. A charging device for a shaft furnace comprising:

a distribution chute for distributing bulk material on a charging surface of said shaft furnace;

a drive mechanism capable of rotating said distribution chute about an essentially vertical axis and pivoting said distribution chute about an essentially horizontal axis so as to allow distribution of bulk material on said charging surface;

said distribution chute having a trough-shaped main part with an open impact section and an outlet section, said trough-shaped main part including a downstream extent and a sliding channel between said impact section and said outlet section;

said distribution chute comprising a funnel portion arranged downstream of said open impact section, said funnel portion being defined by at least one circumferentially closed region of said sliding channel, wherein said circumferentially closed region of said sliding channel tapers in a direction of flow and towards the downstream extent of said trough-shaped main part such that said outlet of said funnel portion is arranged substantially at said downstream extent of said trough-shaped main part, and said funnel portion comprises a chute portion of said trough-shaped main part and a cover portion covering said chute portion, said cover portion comprising at least one inclined cover plate that is arranged at an angle with respect to a longitudinal central axis of said trough-shaped main part so that said funnel portion tapers in a direction of flow and towards said downstream extent.

11. The charging device according to claim 10, wherein said cover portion comprises a cover having a shape generated by a frustum of a cone.

12. The charging device according to claim 10, wherein said cover portion comprises lateral linking plates for fixing said inclined cover plate to said trough-shaped main part.

13. The charging device according to claim 10, wherein said cover portion comprises a first upstream inclined cover plate, a second downstream inclined cover plate, said first and second inclined cover plates being arranged at an angle with respect to said longitudinal central axis of said trough-shaped main part, and lateral linking plates for fixing said first and second inclined cover plates to said trough-shaped main part.

14. The charging device according to claim 10, wherein said funnel portion is arranged so as to guide and centre a flow of bulk material on a central axis of said shaft furnace when said distribution chute is in central charging position.

15. The charging device according to claim 10, wherein said distribution chute comprises mounting flanges for mounting said distribution chute to said drive mechanism, said flanges being configured such that a longitudinal central axis of said main part is offset from said essentially horizontal pivoting axis.

16. A distribution chute for a charging device of a shaft furnace, the charging device capable of rotating said distribution chute about an essentially vertical axis and pivoting said distribution chute about an essentially horizontal axis so as to allow distribution of bulk material on a charging surface in the shaft furnace, said distribution chute comprising:

a trough-shaped main part with an open impact section and an outlet section, said trough-shaped main part including a downstream extent and a sliding channel for bulk material between said impact section and said outlet section, said open impact section extending over at least 40% of the length of said trough-shaped main part;

a funnel portion arranged downstream of said open impact section, said funnel portion being defined by at least one circumferentially closed region of said sliding channel, wherein said circumferentially closed region of said sliding channel tapers in a direction of flow and towards the downstream extent of said trough-shaped main part such that an outlet of said funnel portion is arranged substantially at said downstream extent of said trough-shaped main part.

17. The distribution chute according to claim 16, wherein said funnel portion is limited to 10-50% of the length of said distribution chute.

18. The distribution chute according to claim 17, wherein said funnel portion covers said outlet section and/or said sliding channel.

19. The distribution chute according to claim 16, wherein said distribution chute comprises mounting flanges for mounting said distribution chute to a drive mechanism of said shaft furnace charging device, said flanges being configured such that a longitudinal central axis of said main part is offset from said essentially horizontal pivoting axis.

20. The distribution chute according to claim 16, wherein said funnel portion comprises a chute portion of said trough-shaped main part and a cover portion covering said chute portion.

21. The distribution chute according to claim 20, wherein said cover portion comprises a cover having a shape generated by a frustum of a cone.

22. The distribution chute according to claim 20, wherein said cover portion comprises an inclined cover plate arranged at an angle with respect to said main part and lateral linking plates for fixing said inclined cover plate to said main part.

23. The distribution chute according to claim 20, wherein said cover portion comprises a first upstream inclined cover plate, a second downstream inclined cover plate, said first and second inclined cover plates being arranged at an angle with respect to said main part, and lateral linking plates for fixing said first and second inclined cover plates to said main part.

24. The charging device according to claim 1, wherein said funnel portion is unitarily constructed to achieve circumferential closure and tapering towards said outlet.

* * * * *